US005707258A

United States Patent [19]

Pilotti

[11] Patent Number: 5,707,258

[45] Date of Patent: Jan. 13, 1998

[54] CLAMP FOR CONNECTING THE POLES OF A BATTERY

[75] Inventor: Gianluigi Pilotti, Felizzano, Italy

[73] Assignee: CAVIS S.r.l., Felizzano, Italy

[21] Appl. No.: 637,973

[22] Filed: May 1, 1996

[30] Foreign Application Priority Data

Sep. 15, 1995 [IT] Italy ..... MI950633 U

[51] Int. Cl.[6] ..... H01R 4/42

[52] U.S. Cl. ..... 439/763

[58] Field of Search ..... 439/763, 762, 439/764, 887, 765, 767, 769, 773, 726; 72/379.2, 404

[56] References Cited

U.S. PATENT DOCUMENTS 2,222,577 11/1940 Thompson ..... 439/762
3,739,322 6/1973 Haegert ..... 439/887

*Primary Examiner*—Neil Abrams
*Assistant Examiner*—Barry Mattthew L. Standig
*Attorney, Agent, or Firm*—Bucknam and Archer

[57] ABSTRACT

A clamp for connecting the poles of a battery is disclosed, the clamp being made by shearing and cold-pressing a tinned galvanized brass plate, to reduce environmental pollution with respect to conventional diecast lead alloy clamps.

6 Claims, 3 Drawing Sheets

CLAMP FOR CONNECTING THE POLES OF A BATTERY

BACKGROUND OF THE INVENTION

The present invention relates to a battery terminal clamp construction for connecting the poles or posts of a storage battery.

As known, the clamps for connecting the poles of batteries, in particular in motor vehicles, are conventionally made of lead.

These lead clamps have, of course, electrical and mechanical characteristics suitable for the intended application, but since they are made of a lead material, they can pollute the encompassing environment.

SUMMARY OF THE INVENTION

Accordingly, the aim of the present invention is to provide such a clamp construction, which has suitable electrical and mechanical characteristics, while having a very small environmental impact.

Within the above mentioned aim, a main object of the present invention is to provide such a clamp construction which is very flexible in application, i.e. which can be indifferently used either for the negative pole or for the positive pole of the battery.

Another object of the present invention is to provide such a clamp construction which can be assembled in two directions and which allows electric cables to easily pass through the above portion of the battery.

According to one aspect of the present invention, the above mentioned aim and objects, as well as yet other objects, which will become more apparent hereinafter, are achieved by a clamp construction for connecting the poles of a battery, characterized in that said clamp construction is made of a cold-pressed brass material.

BRIEF DESCRIPTION OF THE DRAWINGS

Further characteristics and advantages of the invention will become more apparent hereinafter from the following detailed disclosure of a preferred embodiment of a clamp construction according to the present invention which is illustrated, by way of an indicative, but not limitative, example, in the figures of the accompanying drawings, where.

DESCRIPTION OF THE PREFERRED EMBODIMENT

Figure 1:
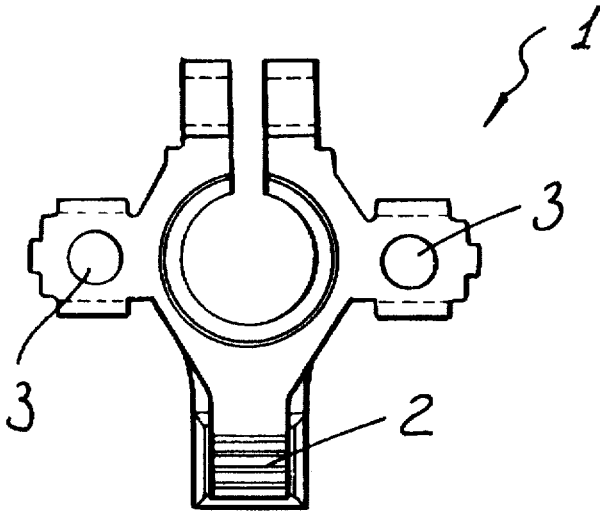
FIG. 1 is a top plan view of the clamp construction according to the present invention.
Figure 2:
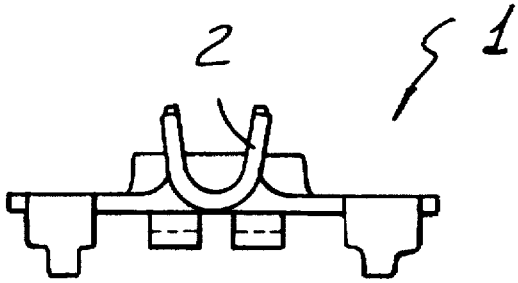
FIG. 2 is a front elevation view of the clamp shown in FIG. 1.
Figure 3:
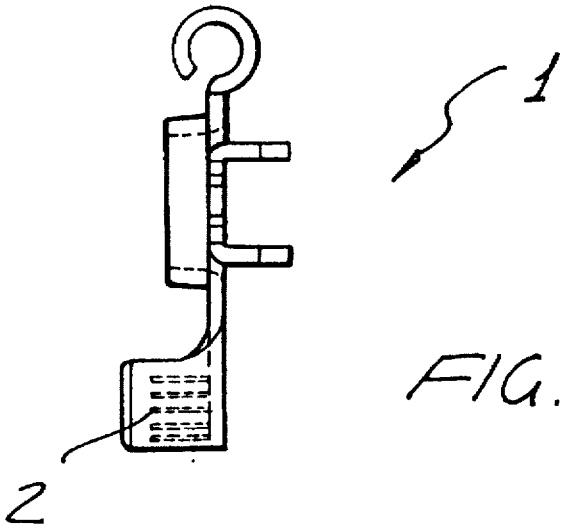
FIG. 3 is a further side elevation view of that same clamp.
Figure 4:
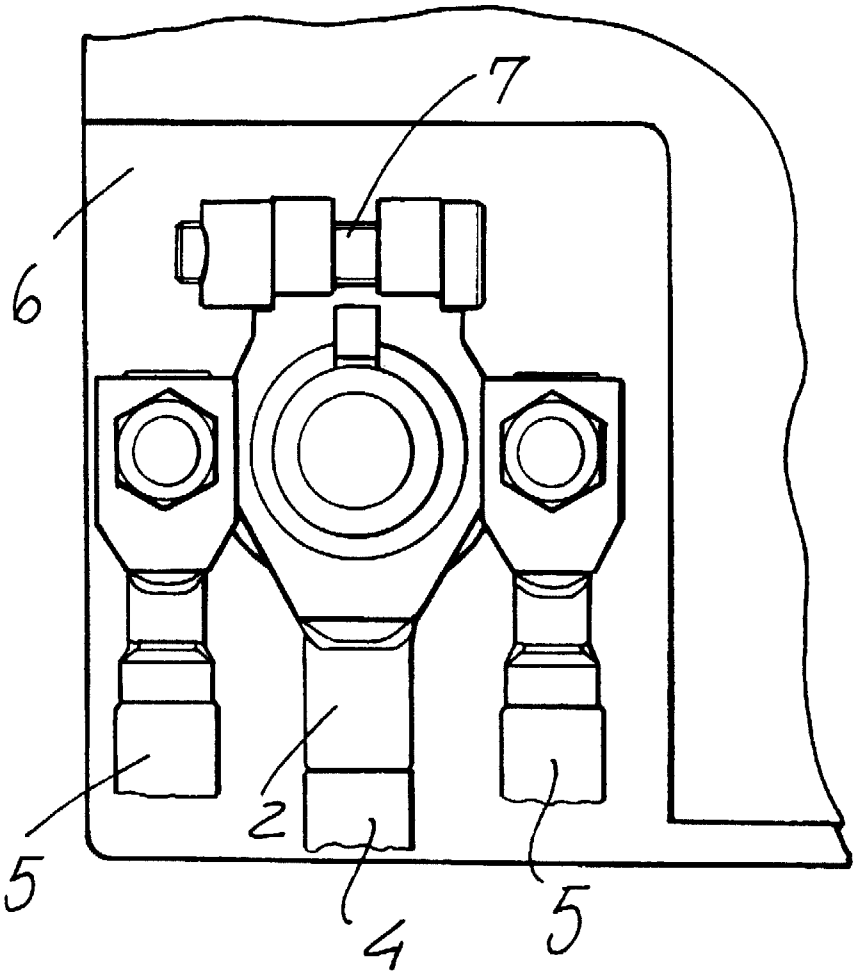
FIG. 4 is a top plan view of the clamp, as applied to the pole or post of a battery.
Figure 5:
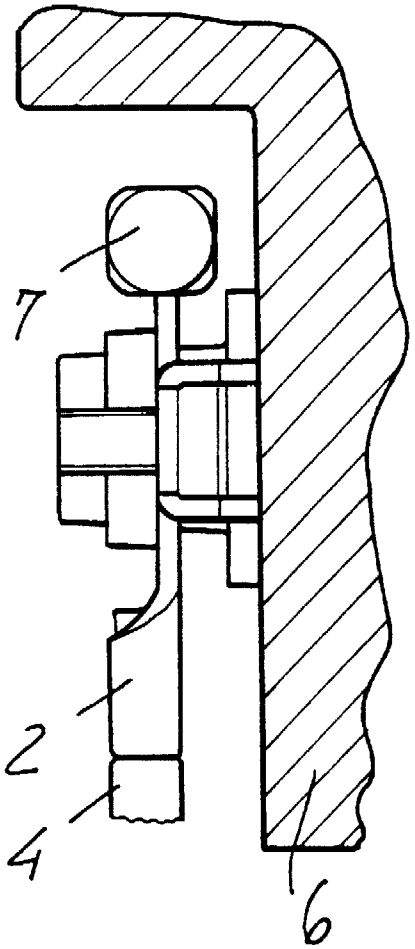
FIG. 5 is a side elevation view of the clamp shown in FIG. 4.

With reference to the number references of the above mentioned figures, the clamp construction or assembly according to the present invention, which has been generally indicated by the reference number 1, is made by shearing and cold pressing a tinned galvanized brass plate, for example made of a brass of the type OT67, OT70 according to the UNI 4894 Standard.

The tin coating of the plate has preferably a thickness of 7 microns.

The clamp construction, as shown, comprises a clamping portion 2, for receiving electric cables 4 therein, of different cross-sections, typically from 10 to 35 $mm^2$, and having two holes 3 or threaded seats for receiving up to four auxiliary cables each, for supplying auxiliary services.

As shown the clamping portion 2 has an ideal longitudinal axis which substantially coincides with the longitudinal axis of the clamp assembly 1, whereas the holes 3 are defined through two lugs (not numbered, arranged cross-wise of said ideal longitudinal axis.

The mentioned auxiliary cables 5 have generally a cross-section less than or equal to 10 $mm^2$.

In this connection it should be pointed out that the clamping of the electric cable in the clamping portion 2 is advantageously performed only on the inner copper material, without the need of providing on the clamp additional fins which would be necessary for also clamping the insulating material.

This will allow to greatly reduce the making cost of the clamp, as well as the weight and size thereof, so as to allow the clamp to be assembled in the two directions on the novel batteries standardized according to the DIN Standards.

Figure 6:
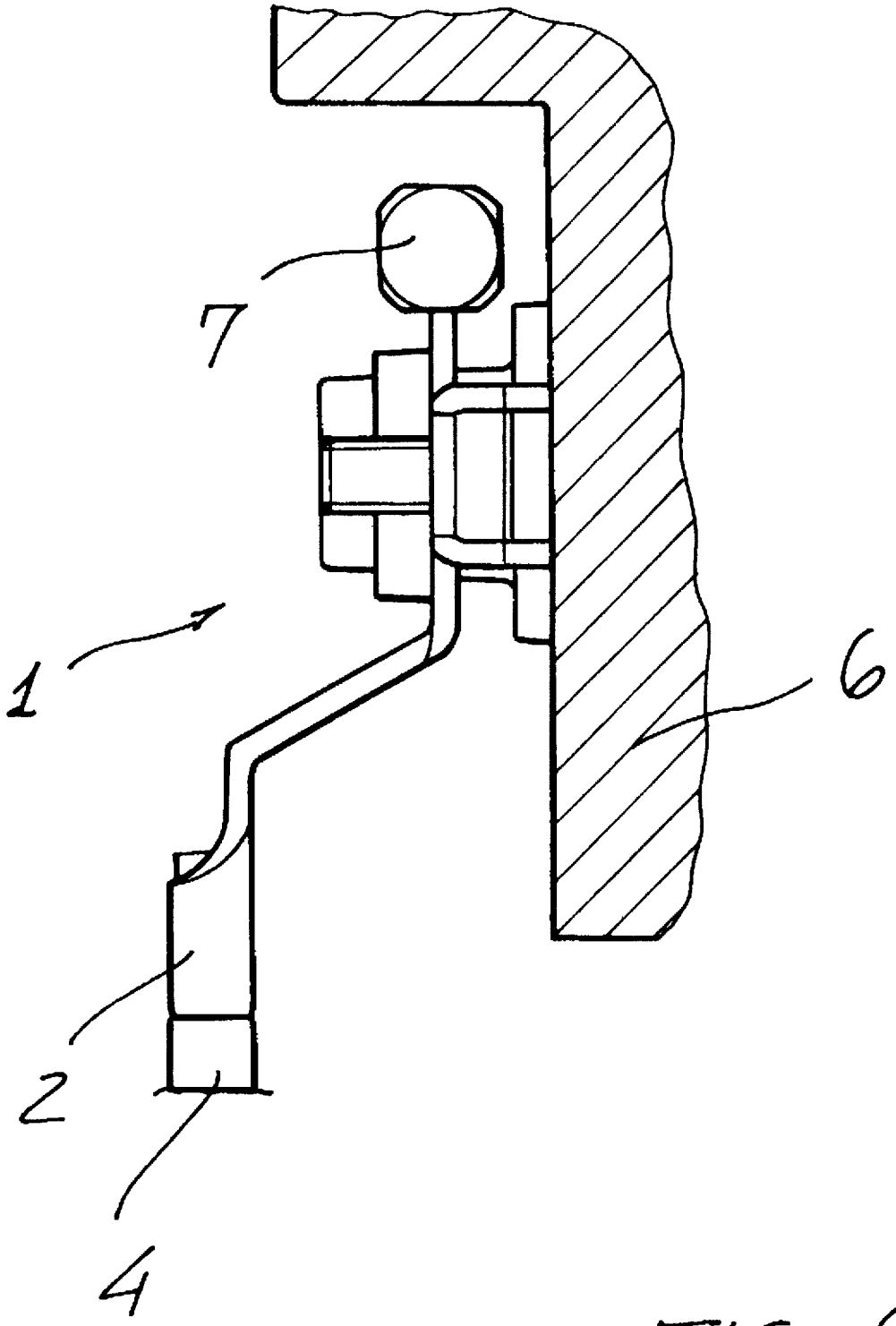
FIG. 6 is a side elevation view of clamp which has been so contoured as to be applied to a battery by causing the electric cables to pass on the top portion of the battery.

Moreover, the clamping portion 2 can be suitably contoured, (for example arranged at a raised position) as illustrated for example in FIG. 6, so as to allow the electric cables 4 to pass through the top portion of the battery 6, if this is required.

The clamp 1 can be moreover used either as a clamp for the positive pole or post of the battery, or as a clamp for the negative pole of said battery, by simply changing the affixing hole on the battery pole, whereas, by reversing the clamping bolt 7, the clamp can be used either as a right or as a left clamp.

Thus, from the above discussion it should be apparent that the invention fully achieves the intended aim and objects, since a clamp has been provided which has the desired functional characteristics, while having a less environmental impact owing to the use of the tinned brass material instead of the conventional lead material.

A further advantage of the invention is that of the great reduction of the weight of the clamp, from 25% to 35% with respect to a conventional clamp made of a diecast lead alloy.

In practicing the invention, the used materials, as well as the size can be any depending on requirements.

I claim:

1. A battery terminal clamp assembly for storage batteries, said clamp being designed for clamping either a negative pole or a positive pole of said storage battery and being adapted to be used either as a right or a left clamp assembly, said clamp being made in a single piece by shearing and cold-pressing a brass material, said clamp comprising a clamping portion designed for clamping only a copper material of an electric cable to be clamped, said clamping portion having a longitudinal axis substantially coinciding with a longitudinal axis of said clamp assembly, said clamp assembly comprising moreover two cross-wise lugs through each of which is defined a throughgoing hole for receiving therein up to four auxiliary cables.

2. A clamp assembly according to claim 1, said clamp being made of a tinned brass material.

3. A clamp assembly according to claim 1, said clamp being made of a tinned galvanized brass material.

4. A clamp assembly according to claim 1, said clamp being made of OT67 or OT70 brass material according to the UNI 4894 Standard.

5. A clamp assembly according to claim 1, in which said electric cable has a cross-section of substantially 10 to 35 $mm^2$.

6. A clamp assembly according to claim 1, in which said clamping portion is so raised as to allow said electric cable to pass through a top portion of said storage battery.

* * * * *